US009394141B2

(12) United States Patent
Krause et al.

(10) Patent No.: US 9,394,141 B2
(45) Date of Patent: Jul. 19, 2016

(54) ELEVATOR SYSTEM

(75) Inventors: Michael Krause, Hannover (DE); Uwe Krause, Pattensen (DE); Guido Sonntag, Gehrden (DE); Michael Wittkowski, Telgte (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 77 days.

(21) Appl. No.: 14/129,749

(22) PCT Filed: Jun. 14, 2012

(86) PCT No.: PCT/EP2012/061271

§ 371 (c)(1),
(2), (4) Date: Dec. 27, 2013

(87) PCT Pub. No.: WO2013/000718

PCT Pub. Date: Jan. 3, 2013

(65) Prior Publication Data

US 2014/0138188 A1 May 22, 2014

(30) Foreign Application Priority Data

Jun. 28, 2011 (DE) ..... 10 2011 078 164

(51) Int. Cl.

| | |
|---|---|
| ***B66B 13/06*** | (2006.01) |
| ***B66B 13/12*** | (2006.01) |
| ***B66B 13/08*** | (2006.01) |

(52) U.S. Cl.

CPC ..... *B66B 13/12* (2013.01); *B66B 13/06* (2013.01); *B66B 13/08* (2013.01)

(58) Field of Classification Search

CPC ..... B66B 13/02; B66B 13/08; B66B 13/12

USPC ..... 187/319, 330

See application file for complete search history.

(56) References Cited

U.S. PATENT DOCUMENTS 1,735,153 A * 11/1929 Bouton ..... 187/323
5,711,112 A * 1/1998 Barten ..... B66B 13/08 49/118

(Continued)

FOREIGN PATENT DOCUMENTS

CN 1243801 2/2000
CN 1792759 6/2006

(Continued)

OTHER PUBLICATIONS

English Machine Translation of JP 08-143252 A.*

(Continued)

*Primary Examiner* — William E Dondero
*Assistant Examiner* — Diem Tran
(74) *Attorney, Agent, or Firm* — Henry M. Feiereisen LLC

(57) ABSTRACT

A shaft door device and a cab door device are included in an elevator system. The shaft door device has a shaft door and a shaft door closer, and the cab door device includes a cab door. The shaft door closer is operatively connected to the shaft door such that a closing force is exerted onto the shaft door. This provides an improved elevator system which allows a quick opening of the shaft door with an energy-efficient and compact door controlling device. This is achieved by including a compensator which can be operatively connected to the shaft door such that the compensator compensates for at least a part of the closing force acting on the shaft door at least in phases during the opening process of the shaft door.

14 Claims, 3 Drawing Sheets

(56) References Cited

U.S. PATENT DOCUMENTS

| | | | | |
|---|---|---|---|---|
| 6,142,260 | A * | 11/2000 | Shin | 187/333 |
| 6,918,211 | B2 * | 7/2005 | Nakano | 49/360 |
| 2005/0045430 | A1 * | 3/2005 | Wernas | 187/333 |
| 2006/0175143 | A1 | 8/2006 | Fujita et al. | |
| 2006/0180404 | A1 * | 8/2006 | Christen | B66B 13/08 187/315 |
| 2007/0039784 | A1 * | 2/2007 | Koizumi | B66B 13/22 187/339 |

FOREIGN PATENT DOCUMENTS

| | | | | |
|---|---|---|---|---|
| DE | 537 483 | | 11/1931 | |
| DE | 102011078164.1 | | 6/2011 | |
| EP | 1 671 917 | A1 | 6/2006 | |
| JP | 08143252 | A * | 6/1996 | B66B 13/12 |
| JP | 2001302154 | A * | 10/2001 | |
| JP | 2004-292115 | | 10/2004 | |
| WO | WO 2012087373 | A1 * | 6/2012 | |

OTHER PUBLICATIONS

Office Action issued Aug. 4, 2014 in corresponding Chinese Patent Application No. 201280032796.8.

English Abstract for Japanese Patent Application Publication No. 2001-302154, dated Oct. 31, 2001.

Office Action for German Application No. 10 2011 078 164.1 dated Feb. 17, 2012.

International Search Report for PCT/EP2012/061271 dated Sep. 19, 2012.

* cited by examiner

ELEVATOR SYSTEM

CROSS REFERENCE TO RELATED APPLICATIONS

This application is the U.S. national stage of International Application No. PCT/EP2012/061271, filed Jun. 14, 2012 and claims the benefit thereof. The International Application claims the benefit of German Application No. 10 2011 078 164.1 filed on Jun. 28, 2011, both applications are incorporated by reference herein in their entirety.

BACKGROUND

Described below is an elevator system with a shaft door device and a cab door device.

Elevator systems must, particularly if they are intended to carry passengers, possess various safety mechanisms in order to comply with safety requirements. For example, it must be ensured that an opened shaft door of a shaft door device is automatically closed in the non-coupled state, so that a person cannot fall into the elevator shaft. The elevator shaft is the shaft in which the elevator cab can travel upwards and downwards. A non-coupled state exists when the cab door device, which is a part of the elevator cab, is not in the same position (stopping point in the shaft) as the shaft door device in the corresponding shaft. In particular, in the non-coupled state there is no operative mechanical connection between the shaft door device and the cab door device, i.e. they are not coupled to one another. Automatic closing of the shaft door must also be assured, in particular when the shaft door device is in a currentless state. For this purpose the shaft door device of the elevator system usually has a shaft door closer that ensures that the shaft door of the shaft door device automatically assumes the closed position in the opened non-coupled state. As it is also necessary for this mechanism to be assured in the currentless state it is not possible to use an electric motor as a shaft door closer. In most cases therefore the shaft door closer is embodied by a weight that is operatively connected to the shaft door by a wire rope pulley fed over a guide roller such that a closing force F2 is exerted onto the shaft door, particularly in the opened state, so that the shaft door is moved in the direction of the closed position. In most cases, the closing force F2 caused by the shaft door closer acts on the shaft door without interruption, so that the closing force F2 acting counter to the opening direction must also be brought to bear in order for the shaft door to be opened.

An elevator system stops at multiple floors, and it can be the case that the shaft doors on the individual floors are embodied differently. Consequently, it can also be the case that the shaft door closer in particular and, as a result, the closing force F2 acting on the shaft door, vary. It is thus possible, depending on the floor, for differing closing forces F2 to be exerted onto individual shaft doors by the shaft door closer, the forces having to be overcome in order for the door to open each time the cab door device comes to a stop with the cab. If the shaft door closer is, for example, embodied as a weight, the weight usually has a mass of approx. 3 to 10 kg, depending on the particular shaft door.

Usually, for the purpose of opening a shaft door, the cab door device is coupled to the shaft door device in order to establish an operative mechanical connection between the cab door device and the shaft door device. The coupling can, for example, be achieved by a bar that is located on the cab door device and, when the cab door device stops at the corresponding position in the shaft (stopping point in the shaft), establishes an operative mechanical connection to the shaft door device, so that forces can be transferred by the cab door device to the shaft door device, and in particular to its shaft door, or vice versa. The opening of one of these doors is usually directly driven by an electric motor. As the two doors are connected to one another in the coupled state, for example by the bar, the forces of the electric motor are also transferred to the coupled door, so that in addition to the door directly driven by the electric motor, the door coupled to the directly driven door is also opened. If, for example, the cab door is opened directly by the electric motor, the shaft door is also opened, as a result of the operative mechanical connection between the cab door and the shaft door. As soon as the two doors (cab door and shaft door) are coupled to one another both doors can be opened by the electric motor. As the electric motor is in most cases housed in the cab door device and directly drives the cab door, the shaft door is in most cases opened as a result of the operative mechanical connection between the shaft door and the cab door. The shaft door is thus indirectly opened via the electric motor.

SUMMARY

Described below is an improved elevator system which allows a quick opening of a shaft door with an energy-efficient and compact door controlling device in particular.

Described below is an elevator system having a shaft door device and a cab door device, wherein the shaft door device includes a shaft door and a shaft door closer and the cab door device includes a cab door, wherein it is possible for the shaft door closer to be operatively connected to the shaft door such that a closing force F2 is exerted onto the shaft door, and wherein the elevator system further includes a compensator which can be operatively connected to the shaft door such that the compensator compensates for at least a part of the closing force F2 acting on the shaft door at least in phases during the opening process of the shaft door.

The opening process of the shaft door is the time taken by the closed shaft door to assume the completely opened state. The opening process of the cab door is the time taken by the closed cab door to assume the completely opened state.

In particular, the shaft door closer is operatively connected to the shaft door such that, by the closing force F2 acting on the shaft door, the shaft door in the non-coupled opened state is automatically moved into the closed position by the closing force F2.

In known elevator systems, during the opening process of the coupled shaft and cab door, the load for the electric motor opening the shaft door is very high due to the closing force F2 exerted onto the shaft door by the shaft door closer. Very high momentary output is required of the electric motor used, particularly in the event of rapid acceleration of the shaft door's movement in the opening direction. This high momentary output, in particular, has an enormous influence on the size and cost of the electric motor and the accompanying door controlling device.

In the elevator system described herein, on the other hand, at least a part of the closing force F2 acting on the shaft door is compensated for by the compensator, at least in phases during the opening process of the shaft door, so that the load on the electric motor is reduced during this compensation phase. An elevator system of this type has several advantages. For example, the electric motor can be designed for smaller loads and, in particular, the momentary output of the electric motor can be reduced. As a result of the fact that the compensator reduces the load to be applied to the electric motor at least in phases during the shaft door's movement from the closed state to the opened state, a more compact and inexpensive electric motor can be used. Also, as a result of the low load for the electric motor during opening of the shaft door, a more energy-efficient and compact door controlling device for the elevator system can be used. The shaft door can also be opened more quickly, as at least in phases during the opening process at least a part of the closing force is compensated for by the compensator.

In an advantageous embodiment, the compensator is coupled to the shaft door such that during at least 50% of the opening process relative to the opening distance to be covered by the shaft door at least a part of the closing force F2 is compensated for by the compensator.

In another advantageous embodiment, the compensator is operatively connected to the shaft door such that the closing force is compensated for by the compensator during the entire opening process of the shaft door.

In a further advantageous embodiment, the compensator is embodied such that the closing force F2 acting on the shaft door can be completely compensated for. The force may be exerted onto the shaft door by the compensator during the opening process is greater than the closing force F2.

In one advantageous embodiment, either the compensator and/or the shaft door closer is an energy storing system. The energy storing system is, for example, a spring, an elastic element or a weight. In particular, the energy storing system exerts the same force on the component to which it is coupled when it is in the currentless state. If, for example, both the compensator and the shaft door closer are embodied by a weight, the weight in each case can emit or absorb, and thus store, potential energy. The weight can be operatively connected to the door by a suitable connection with the door in question (e.g. by a rope fed over a guide roller), so that forces are transferable. The energy storing system should particularly not be understood to be an electric motor.

In a further advantageous embodiment, the compensator can only compensate for at least a part of the closing force F2 acting on the shaft door when the cab door device is in the state of being coupled to the shaft door device. As a result it is possible, in the coupled state, for the force acting on the shaft door in the direction of the closed position of the shaft door to be reduced or removed. The compensator is thus only coupled to the shaft door for the purpose of opening the shaft door. In the non-coupled state, the closing force F2 acting on the shaft door is not reduced by the compensator. In this way it is possible to ensure that the automatic closing of the shaft door can happen independently in the opened non-coupled state, and that in the coupled state it is possible for the driving load for the electric motor to be reduced at least in phases during the opening process.

The compensator may be coupled to the shaft door device at the moment the cab door is coupled to the shaft door. The compensator may be coupled by a mechanical system in conjunction with the door bar (door coupling mechanism for the cab door and shaft door). In order to minimize noise castors or similar can also be used.

In a further advantageous embodiment, the force exerted onto the shaft door device by the compensator is equal to or greater than the closing force F2 at least intermittently during the opening process of the shaft door. In particular, these forces (the closing force F2 and the force of the compensator acting on the shaft door device) are considered as acting on the shaft door device (such as on the shaft door) at the same point.

In another advantageous embodiment, the cab door device includes the compensator. As a result it is not necessary for each shaft door device of the elevator system to have a compensator, as this is provided by the cab door device. The mechanical coupling of the cab door device to the corresponding shaft door device can result in a transfer of force between the two devices, allowing, as a result of the compensator, a reduction in the closing force F2 acting on the sliding door in the direction of the closed position.

In a further advantageous embodiment, the compensator exerts a locking force on the cab door when the cab door is in the closed position, so that the cab door is held closed. In particular, the compensator is embodied such that, by the locking force of the compensator in the currentless closed state of the cab door device, the cab door retains the closed position without the action of an external force (e.g. exerted by a person).

In a further advantageous embodiment, the cab door device includes an electric motor which, during the opening process of the cab door, can become operatively connected to the cab door and to the shaft door coupled to the cab door such that both doors can be opened by the electric motor. Alternatively, the shaft door device can include an electric motor which is operatively connected to the shaft door during the opening process of the latter and which is operatively connected to the cab door coupled to the shaft door such that both doors can be opened by the electric motor.

In another advantageous embodiment, the shaft door closer exerts a closing force F2 on the shaft door so that when the shaft door device is in the state of being not coupled to the cab door device the opened shaft door is closed by the closing force F2. The closing force F2 thus assures the closing of the shaft door, provided the cab door device is not coupled to the shaft door device. The shaft door closer thus exerts a closing force onto the shaft door that can move an opened shaft door in the direction of the closed position of the shaft door. This closing force F2 must also be brought to bear in order to open the shaft door when it is in the coupled state. As a result of the compensator this closing force can be reduced or completely removed, at least in phases. This enables faster and more energy-efficient opening of the shaft door.

In a further advantageous embodiment, the shaft door device includes the compensator. It is thus possible, depending on the floor, for a compensator that is precisely adapted to the shaft door closer to be built into the shaft door device, so that optimal compensation of the closing force F2 when the shaft door device is in the state of being coupled to the cab door device is possible during the opening process. The compensator may be adapted to the shaft door closer becomes operatively connected to the shaft door device during the coupling of the cab door device to the shaft door device, so that at least a part of the closing force F2 is compensated for, at least in phases during the opening process of the shaft door.

In a further advantageous embodiment, there is a delay between the opening of the cab door and the opening of the shaft door. The cab door may be first opened sufficiently far for the compensator to be positioned such that it can compensate for the closing force F2 for the electric motor acting on the shaft door. The shaft door is then also opened. This enables the output required of the electric motor to be reduced and fast opening of the cab and shaft doors to be assured. The time delay can, for example, be brought about by the coupling mechanism between the cab door device and the shaft door device, in particular between the cab door and the shaft door. The opening of the shaft door thus may start from the point in time at which the force exerted onto the shaft door by the compensator is able to reduce the force generated by the closing force F2 for the electric motor.

In a further advantageous embodiment, the operative connection of the compensator to the shaft door is established during the coupling of the cab door device to the shaft door device and broken when the cab door device is uncoupled from the shaft door device.

In a further advantageous embodiment, the compensator provides an opening and/or locking aid for the cab door and/or the shaft door even when no counterweight is present on the shaft door. It is thus possible to assure the locking closed of the cab door and/or improved opening of the cab door and/or the shaft door by the compensator.

The underlying idea is based can be applied equally well to doors or gates of any type, for example, sliding doors, platform screen doors, machine tool doors, safety gates and cold store gates.

BRIEF DESCRIPTION OF THE DRAWINGS

These and other aspects and advantages will become more apparent and more readily appreciated from the following description of the exemplary embodiments, taken in conjunction with the accompanying drawings of which.

DETAILED DESCRIPTION OF THE PREFERRED EMBODIMENT

Figure 1:
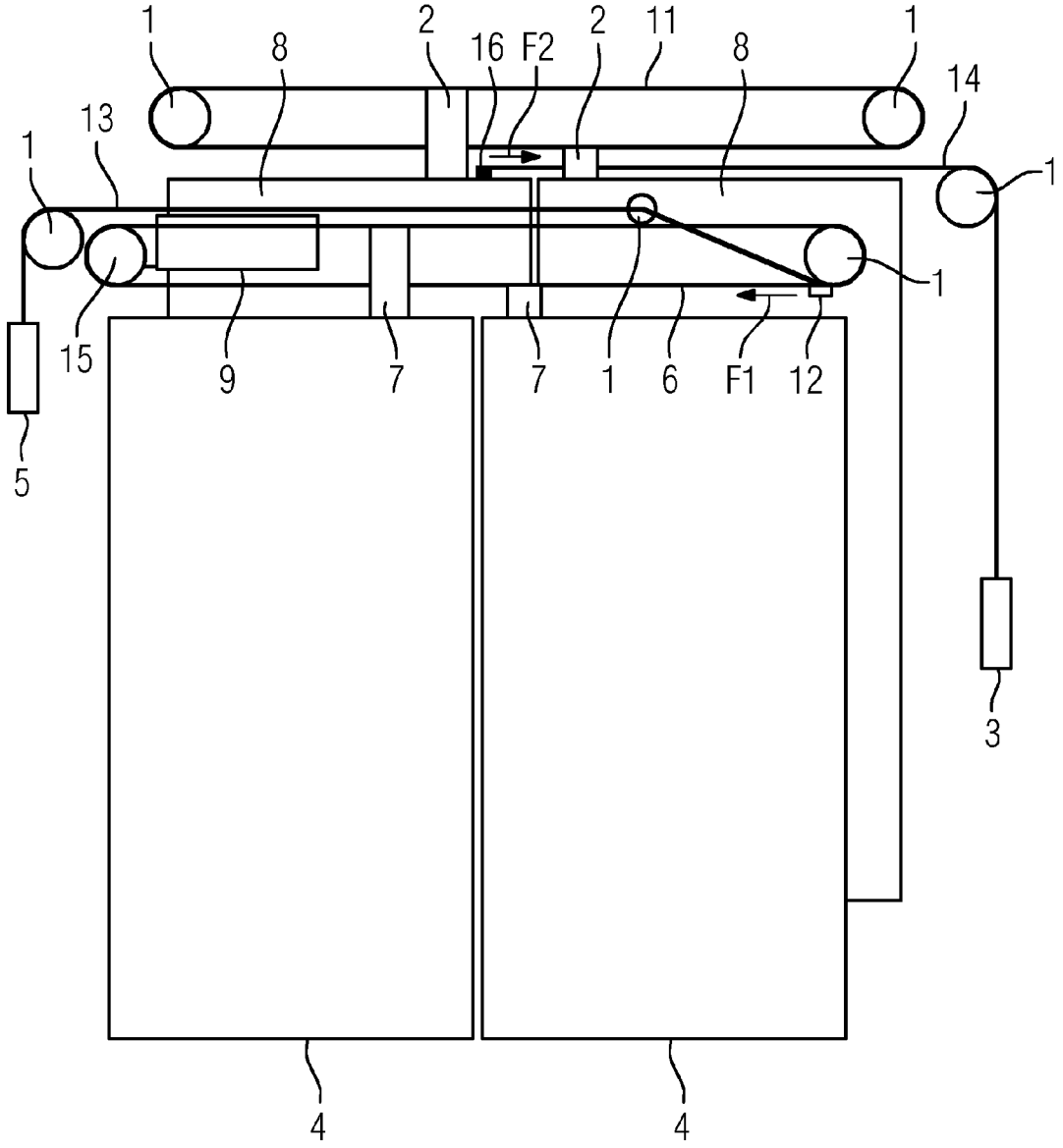
FIG. 1 is a schematic representation of an elevator system with the doors closed.

Reference will now be made in detail to the preferred embodiments, examples of which are illustrated in the accompanying drawings, wherein like reference numerals refer to like elements throughout.

Figure 2:
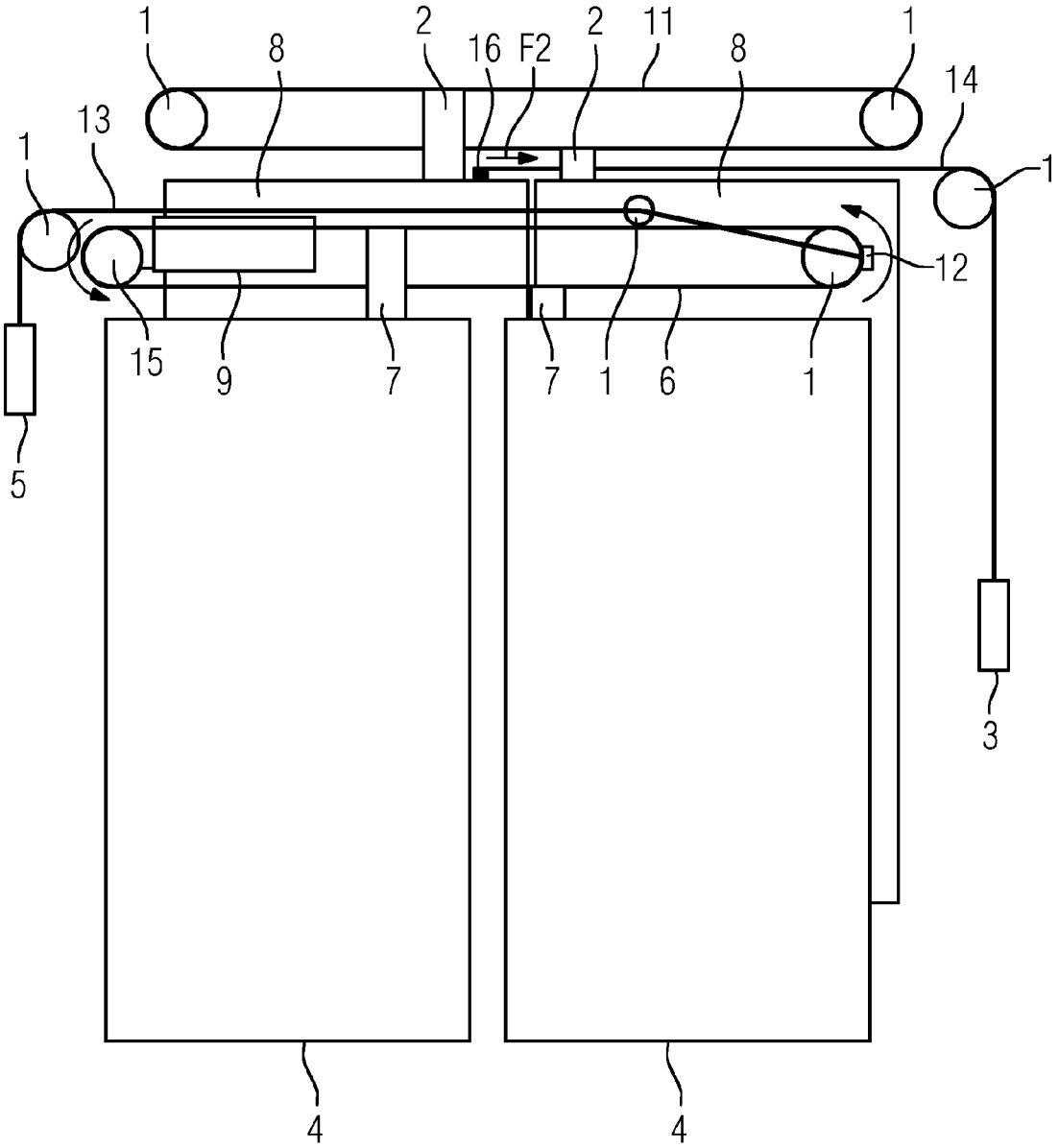
FIG. 2 is a schematic representation of the elevator system in FIG. 1, in which the cab door is partly opened and the shaft door is closed
Figure 3:
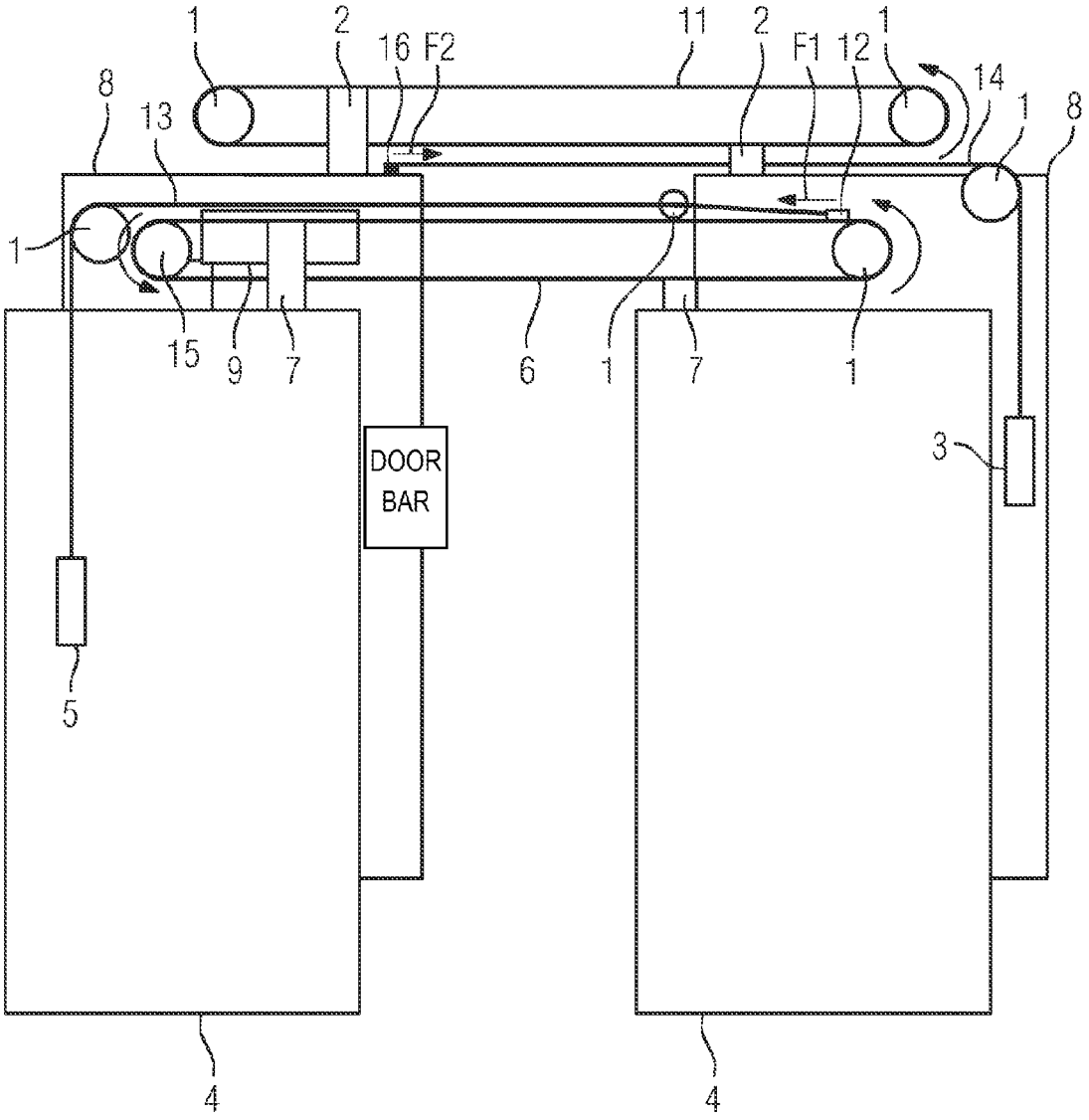
FIG. 3 is a schematic representation of the elevator system in FIGS. 1 and 2, in which the cab door and the shaft door are partly opened.

The following evaluation of the elevator system as shown in FIGS. 1 to 3 is based on an ideal system in which the frictional forces are not taken into consideration.

FIG. 1 shows a schematic representation of an elevator system with the doors closed. The elevator system includes a cab door device and a shaft door device for each floor at which the elevator is to stop.

The cab door device includes a cab door via which people can enter and leave the cab. The cab door depicted is in the closed position, meaning that nobody can enter or leave the cab at that moment. The cab door has two door leaves 4 that are moved in opposing directions in order to open the door. The cab door device includes an electric motor 9 for electrically opening and closing the cab door, a drive pinion 15, a belt 6, a guide roller 1 and, for each leaf 4 of the cab door, a door entrainer 7 that is connected to the corresponding door leaf 4 of the cab door and to the belt 6. The drive pinion 15 can be driven by the electric motor 9 so that the belt 6 can be moved by the drive pinion 15. The belt 6 is stretched over the drive pinion 15 and the guide roller 1 and has two door entrainers 7, so that it can transfer the force transferred by the electric motor 9 via the drive pinion 15 to the cab door by the door entrainers 7, so that the door leaves 4 of the cab door can be opened or closed to equal extents.

The shaft door device has a shaft door with 2 door leaves 8, three guide rollers 1, a belt 11, two door entrainers 2, a second fastening element 16, a second rope 14 and a shaft door closer 3. The belt 11 is stretched over two guide rollers 1, so that a transfer of force can take place via the belt. Each door leaf 8 of the shaft door is fastened to the belt 11 by the corresponding door entrainer 2, so that when the belt 11 moves in a direction the shaft door can be opened to an equal extent, and when the belt 11 moves in the opposite direction the shaft door can be closed to an equal extent. For safety reasons the shaft door device has the shaft door closer 3, which ensures that the shaft door automatically assumes the closed position in the non-coupled, fully or partially opened state. In this way a shaft door can, for example, be prevented from standing open despite the elevator cab's being at another floor. In the present exemplary embodiment the shaft door closer 3 is embodied by a weight that is connected to a door leaf of the shaft door by the second rope 14 fed over the guide roller 1. To achieve this, the first end of the second rope 14 is connected to one of the door leaves 8 by the second fastener 16 and the second end of the second rope 14 is connected to the shaft door closer 3. The second rope 14 is fed over the guide roller 1, so that a specific force can be transferred to the shaft door. It is also conceivable for the first end of the rope 14 to be directly connected to the belt 11, so that a force is exerted onto the shaft door in the direction of the closed position of the shaft door. The shaft door closer 3 is then operatively connected to the shaft door such that a closing force F2 is exerted onto the shaft door, in particular onto a door leaf 8 of the shaft door, so that the shaft door can be moved in the direction of the closed position. FIG. 1 shows the closed position of the shaft door and the cab door. The shaft door closer 3 embodied as a weight thus exerts a closing force F2 onto one of the door leaves 8 of the shaft door by the second rope 14 fed over the guide roller 1. As the two door leaves 8 of the shaft door are coupled to one another via the belt 11 this closing force F2 is also transferred to the other door leaf, so that the shaft door can be closed.

The closing force F2 caused by the shaft closer 3 acts on the shaft door without interruption, so that the closing force F2 must also be overcome in order for the shaft door to be opened.

In order to open the shaft door, the cab door is first coupled to the shaft door by a coupling. The coupling can, for example, be achieved by a door bar. The door bar establishes an operative mechanical connection to the shaft door device when the cab door device stops at the corresponding shaft door, so that forces can be transferred to the shaft door device by the cab door device. In particular, when the cab door device is coupled to the shaft door device the cab door is coupled to the shaft door by the coupling. If the cab door is opened as a result, a force is then also transferred to the shaft door via the coupling, so that the shaft door is also opened. The electric motor 9 of the cab door device thus also ensures that the shaft door is opened.

In particular, the closing force F2 produced by the shaft door closing 3 must be overcome for the shaft door to be opened.

In order to minimize the load that needs to be applied to the electric motor 9 to open the cab door and shaft door, the cab door device also includes a compensator 5, a first rope 13, two guide rollers 1 and a first fastening element 12. The compensator 5 is operatively connected to the shaft door in the coupled state such that during the opening process of the shaft door 8 the closing force F2 acting on the shaft door is compensated for by the compensator 5.

To achieve this, the compensator 5, which is embodied as a weight, is connected to the belt 6 via the first rope 13. The first end of the first rope 13 is connected to the compensator 5 and the other end of the first rope 13 is connected to the belt 6 by a first fastening element 12. The first rope 13 is fed over two guide rollers 1, so that a specific force can be transferred by the compensator 5 to the belt 6 and thus to the cab door.

The compensator 5 thus exerts a force F1 onto the belt 6. As a result of the fact that the fastening element 12 is placed slightly in front of a guide roller 1, the force F1 generated by the compensator 5 can ensure that, when the cab door is in the closed state, for example in the event of a power outage, the cab door is held closed by the force F1, so that accidental opening of the cab door can be prevented.

In the present exemplary embodiment the force F1 generated by the compensator 5 on the belt 6 is equal to the closing force F2 generated by the shaft door closer 3. The force F2 can however also be greater or smaller than the closing force F1.

The coupling of the cab door to the shaft door may be configured such that the transfer of force from the cab door to the shaft door that is required to open the shaft door only takes place when the first fastening element 12 is positioned on the belt 6 such that the force F1 acts in support of the electric motor 9. In particular, this is the point in time from which at least part of the force F1 generated by the compensator 5 on the belt 6 is exerted in the direction of movement of the first fastening element 12.

The electric motor 9 must therefore first produce the force F1 to open the cab door. Once the first fastening element 12 has passed the apex of the roller the compensator 5 assists the opening process of the cab door. As the mechanical transfer of force between the cab door and the shaft door takes place via the coupling from this point in time, the closing force F2 generated by the shaft door closer 3 can be compensated for by the compensator 5. As the force F1 generated by the compensator 5 on the belt 6 is equal to the closing force F2 acting on the shaft door 8 the force required to open the cab door and/or the shaft door is reduced considerably. The energy consumption of the electric motor and that of the controls can be minimized to a great extent. Fast opening of the doors is thus possible with simpler means (e.g. smaller and less expensive controls).

The compensator 5 thus ensures in particular that the output required of the electric motor 9 for the opening process of the cab door and the shaft door is minimized. There is also a saving in the energy required to hold an opened shaft door and/or cab door in its opened position and for holding the closed cab door in its closed position. The elevator system can thus be operated with a more cost-efficient and compact electric motor 9 and with more cost-efficient and compact door control devices compared to known elevator systems.

FIG. 2 shows a schematic representation of the elevator system in FIG. 1 in which the cab door is partly opened and the shaft door is closed. The door leaves 4 of the cab door are consequently already slightly opened. In FIG. 2 the first fastening element 12 is located at the apex of the guide roller 1. From this point in time the force F1 generated on the belt by the compensator 5 acts in support of the opening force to be generated on the belt 6 by the electric motor. As the force F1 generated by the compensator 5 on the belt 6 is equal to the closing force F2 generated by the shaft door closer 3 the closing force generated by the shaft door closer 3 is compensated for. The transfer of force between the cab door and the shaft door may take place during the opening process of the cab door from the moment when the first fastening element 12 passes the apex of the roller 1. From this point in time the compensator 5 assists the opening process of the cab door and the shaft door, so that fast opening of the cab door and in particular the shaft door is possible using a more compact electric motor and door control device. It is also conceivable for the force F1 generated by the compensator 5 to be greater or smaller than the closing force F2.

FIG. 3 shows a schematic representation of the elevator system in FIGS. 1 and 2 in which the cab door and the shaft door are partly opened. It can be seen that the force F1 generated by the compensator 5 and exerted onto the belt 6 acts in support of the electric motor 9. As regards the force required to open the cab door and the shaft door the force F1 acts in the opposite direction to the closing force F2 generated by the shaft door closer 3, so that the forces required to open both doors are reduced. The closing force F2 can thus be compensated for by the compensator 5, with the result that an improved elevator system is produced.

In this exemplary embodiment, the compensator 5 and the shaft door closer 3 are embodied as a weight. It is also conceivable for the compensator 5 and the shaft door closer 3 to be embodied as a spring or another energy storing system. Other advantageous embodiments are conceivable in which the closing force F2 generated by the shaft door closer 3 is reduced by a compensator during the opening process of the sliding door. In particular, the number of rollers 1 can vary; the belt 6, 11 or the rope pulley can be replaced by an alternative force transferring; the positioning of the compensator 5 and/or of the electric motor 9 can vary (e.g. on the shaft door device) and the operative mechanical connection between the shaft door closer 3 and the shaft door can vary (e.g. transfer of force via the belt 11 of the shaft door device), etc.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide* v. DIRECTV, 358 F3d 870, 69 USPQ2d 1865 (Fed. Cir. 2004).

The invention claimed is:

1. An elevator system, comprising:

a shaft door device including a shaft door, and shaft door closing means for closing the shaft door;

a cab door device with a cab door, operatively connected to the shaft door such that a closing force is exerted onto the shaft door;

a belt connected to the cab door; and compensating means, connected to the belt by a rope and operatively connected to the shaft door, for opposing at least a part of the closing force acting on the shaft door at least in phases during an opening process of at least the shaft door.

2. The elevator system as claimed in claim 1, wherein of the compensating means and the shaft door closing means is an energy storing system.

3. The elevator system as claimed in claim 2, wherein only when the cab door device is coupled to the shaft door device can the at least a part of the closing force acting on the shaft door be opposed by the compensating means.

4. The elevator system as claimed in claim 3, wherein a compensating force exerted onto the shaft door device by the compensating means is at least as large as the closing force at least intermittently during the opening process of at least the shaft door.

5. The elevator system as claimed in claim 4, wherein the cab door device comprises the compensating means.

6. The elevator system as claimed in claim 5, wherein the compensating means exerts a locking force on the cab door when the cab door is in the closed position, so that the cab door is held closed.

7. The elevator system as claimed in claim 6, wherein the cab door device comprises an electric motor which, during the opening process, is operatively connected to the cab door and to the shaft door coupled to the cab door such that both doors can be opened by the electric motor.

8. The elevator system as claimed in claim 6, wherein the shaft door device comprises an electric motor which, during the opening process, is operatively connected to the shaft door and to the cab door coupled to the shaft door such that both doors can be opened by the electric motor.

9. The elevator system as claimed in claim 8, wherein the shaft door closing means exerts a closing force onto the shaft door, so that an opened shaft door is closed by the closing force when the shaft door device is not coupled to the cab door device.

10. The elevator system of claim 1, wherein the compensating means and the rope are configured to apply an opening force on the shaft door only during an opening process of the cab door and a closing force on the shaft door only during a closing process of the cab door.

11. The elevator system of claim 1, wherein the compensating means only opposes the at least a part of the closing force acting on the shaft door when the cab door is adjacent to the shaft door.

12. A cab door device for an elevator in an elevator shaft having a shaft door, the cab door device comprising:

a cab door, operatively connected to the shaft door such that a closing force is exerted onto the shaft door;

a belt connected to the cab door; and compensating means connected to the belt by a rope, operatively connected to the shaft door, at least a part of the closing force acting on the shaft door being opposed by the compensating means at least in phases during an opening process of the shaft door.

13. The cab door device of claim 12, wherein the compensating means and the rope are configured to apply an opening force on the shaft door only during an opening process of the cab door and a closing force on the shaft door only during a closing process of the cab door.

14. The cab door device of claim 12, wherein the compensating means only opposes the at least a part of the closing force acting on the shaft door when the cab door is adjacent to the shaft door.

* * * * *